US005092637A

United States Patent [19]

Miller

[11] Patent Number: 5,092,637

[45] Date of Patent: Mar. 3, 1992

[54] LATCH ASSEMBLY FOR DOORS

[76] Inventor: Kermit G. Miller, 764 Berkshire Dr., Millbrae, Calif. 94030

[21] Appl. No.: 572,720

[22] Filed: Aug. 24, 1990

[51] Int. Cl.[5] ..... E05C 1/16

[52] U.S. Cl. ..... 292/173; 292/333; 292/150; 292/DIG. 72

[58] Field of Search ..... 292/150, 333, 173, DIG. 72, 292/DIG. 4, 332, 179; 74/2

[56] References Cited

U.S. PATENT DOCUMENTS

| | | | |
|---|---|---|---|
| 45,963 | 1/1865 | Andrews | 292/333 |
| 390,507 | 10/1888 | Morton | 292/179 |
| 1,355,735 | 10/1920 | Crompton et al. | 292/164 |
| 1,768,021 | 6/1930 | Bauerband | 292/333 X |
| 3,605,459 | 9/1971 | Van Dalen | 49/276 X |
| 3,736,778 | 6/1973 | Bako | 70/70 |
| 3,843,174 | 10/1974 | Bogunovich et al. | 292/166 |
| 3,890,814 | 6/1975 | Fantoni | 292/DIG. 72 X |
| 4,049,304 | 9/1977 | Imhoff | 292/333 |
| 4,132,439 | 1/1979 | Millar | 292/144 |

FOREIGN PATENT DOCUMENTS

| | | | |
|---|---|---|---|
| 274321 | 5/1914 | Fed. Rep. of Germany | 292/333 |
| 305765 | 5/1918 | Fed. Rep. of Germany | 292/333 |
| 344005 | 11/1921 | Fed. Rep. of Germany | 292/333 |
| 825047 | 11/1937 | France | 292/333 |

*Primary Examiner*—Eric K. Nicholson
*Assistant Examiner*—Darnell M. Boucher
*Attorney, Agent, or Firm*—John A. Bucher

[57] ABSTRACT

A latch assembly for a door movably mounted on a frame is disclosed together with its method of operation, the assembly including a housing mounted on the frame adjacent an opening for receiving the door, a first pin mounted in a first passageway of the housing with a spring biasing the first pin into extended locking engagement with the door, a second pin being mounted in a second passageway intersecting with the first passageway, a spring biasing the second pin into extension for opening the door from the frame, retainers being interconnected with the first and second pins for securing each pin in a retracted position when the other pin is extended so that the first pin positively locks the door in a closed position retracting the second pin and the second pin positively opens the door when the first pin is retracted by the actuator.

4 Claims, 2 Drawing Sheets

FIG. 1
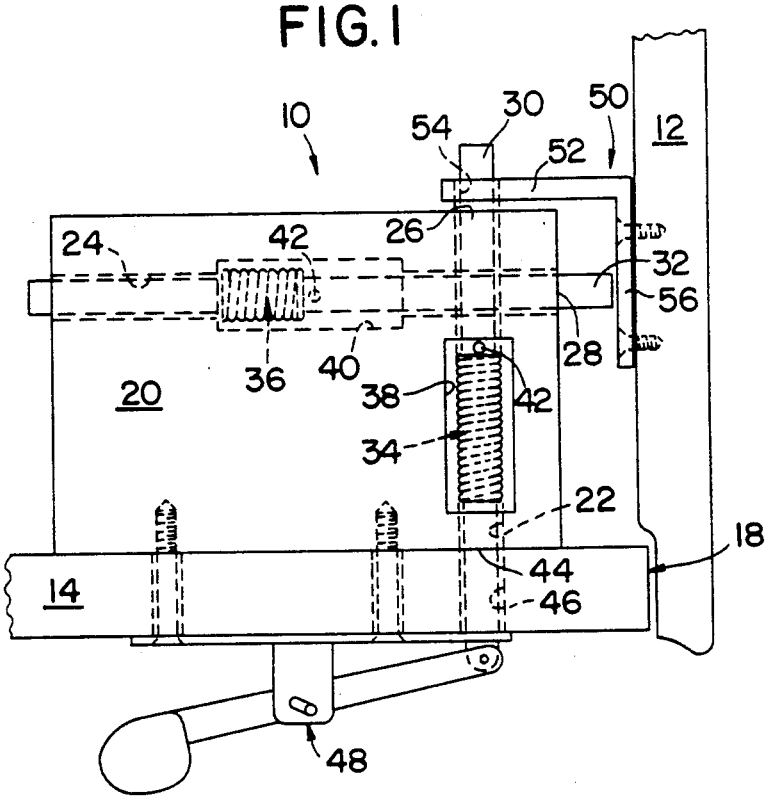
FIG. 3
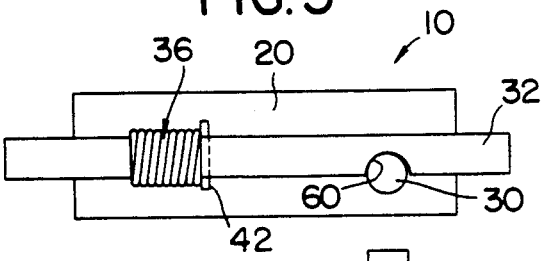
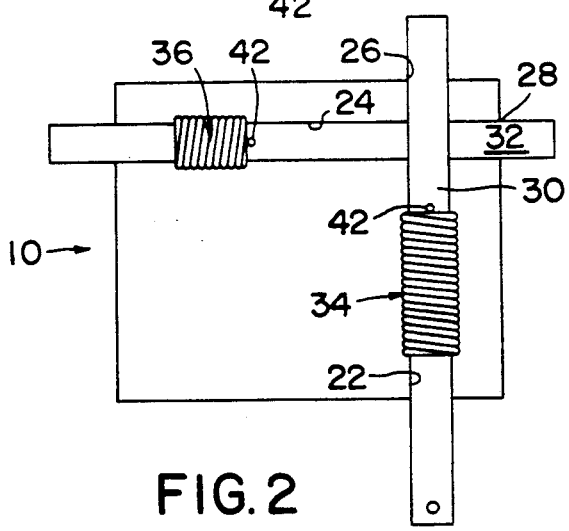
FIG. 2
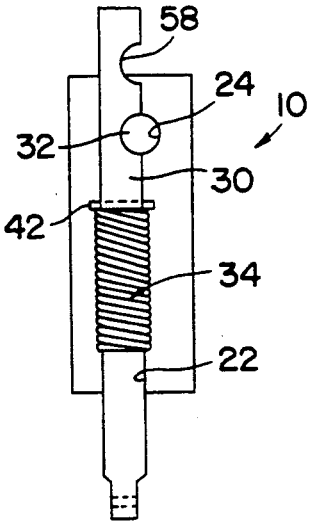
FIG. 4

LATCH ASSEMBLY FOR DOORS

FIELD OF THE INVENTION

The present invention relates to a latch assembly and more particularly a latch assembly for a door movably mounted on a frame.

BACKGROUND OF THE INVENTION

A wide variety of latch assemblies and/or locks are disclosed for door of various types in the prior art. Generally, such latch assemblies are employed in connection with doors movably mounted on a frame, the frame forming an opening for receiving the door. In a typical combination, the door is hinged along one side to the frame so that the door can swing upon its hinges between open position and a closed position. Hinged doors of this type are commonly employed in cabinets for various purposes and also in vehicular doors for example.

As discussed in greater detail below, the present invention particularly contemplates a latch assembly for use with such a cabinet door which is rotatably mounted by hinges or the like on a supporting frame. However, it will be apparent that the latch assembly of the invention may also be employed with other hinge doors, for example those on vehicles and the like. In addition, the latch assembly of the invention may also be employed with doors of different types as long as a portion of the door moves into or toward engagement with a portion of the frame in a closed position and away from the frame portion into an open position.

The present invention further contemplates a latch assembly of the type employing multiple pins which are movably mounted in a housing and interact to control operation of a door.

A variety of latch assemblies of this type are disclosed by U.S. Pat. Nos. 15,963; 1,355,735; 3,736,778 and 3,843,174.

The latter two patents contemplated latches for relatively specific purposes which were accordingly of relatively complex design. U.S. Pat. No. 3,843,174 disclosed an anti-theft door-locking apparatus developing a very large spring load when closed so that the door can readily be opened only by authorized personnel having access to suitable specialized equipment. U.S. Pat. No. 3,736,778 disclosed a combination lock including a slide member movable between latched and unlatched positions while interacting with a plurality of dial type combination locks.

U.S. Pat. No. 15,963 issued Jan. 24, 1865 to Andrews disclosed a basic shutter bolt with a generally conventional latch pin for holding the shutter closed.

U.S. Pat. No. 1,355,735 issued Oct. 12, 1920 to Crompton, et al. disclosed a latch assembly for vehicular doors. Its latch assembly included a first bolt member operable by a second plunger member when a third retaining member was released.

Latch assemblies of the type summarized above are generally representative of the large number of prior art latch assemblies, at least in terms of the present invention.

SUMMARY OF THE INVENTION

There has accordingly been found to remain a need for a latch assembly of simple and reliable construction which is capable of positively locking a door in a closed position and positively opening the door when the latch assembly is released or unlocked.

It is accordingly an object of the present invention to provide such a latch assembly adapted for use with a door movably mounted on a frame and more particularly a door for cabinets and the like where the door is pivotably mounted on a frame adjacent an opening in the frame to be closed by the door.

More specifically, it is an object of the invention to provide a latch assembly for a door movably mounted on a frame with a housing adapted for mounting on the frame, a first pin means movably mounted in the housing and biased by a spring means into extended locking engagement with the door, actuating means being operable for retracting the first pin means, a second pin means also being movably mounted in the housing with a spring biasing it into extension against the door, retaining means being operatively interconnected with the first and second pin means for allowing either pin to be extended from the housing when the other pin is substantially fully retracted into the housing, the latch assembly thereby positively locking the door in a closed position and positively opening the door when the latch assembly is released or unlocked.

Preferably, with the housing being mounted on the frame, a bracket or other means is mounted on the door for locking engagement with the first pin means in its extended locking position. The bracket may also preferably provide a strike plate for engagement by the second pin means when it is extended from the housing.

It is also an object of the invention to provide a latch assembly of the type described above wherein the housing may be mounted upon either the frame or the door and in different orientations while accomplishing the same basic operations noted above. Accordingly, it is a further related object of the invention to provide such a latch assembly wherein the latch assembly is adapted for mounting either on the frame or the door, the first pin means being extendible for locking engagement between the door and frame, the second pin means being extendible from the housing for exerting a positive opening force between the door and frame.

It is yet a further object of the invention to provide a latch assembly by itself which can be mounted upon either a door or supporting frame as described above, the latch assembly including a housing with first and second pins being movably mounted together with biasing springs in first and second passageways arranged in generally perpendicular and intersecting relation, each pin having a recess formed along its length so that when the one pin is substantially retracted in its passageway, the recess completes the passageway for the other pin.

Additional objects and advantages of the invention are set forth in the following description having reference to the accompanying drawings.

BRIEF DESCRIPTION OF THE DRAWINGS

FIG. 1 is a side view, with parts in section, taken through a shelf and door combination with the door closed and further including a latch assembly constructed in accordance with the present invention.

FIG. 2 is an enlarged and partially schematic representation corresponding to the side view of FIG. 1, of the latch assembly itself in a closed or locked position.

FIG. 3 is a view taken from the top of FIG. 2.

FIG. 4 is a view taken from the right side of FIG. 2.

DESCRIPTION OF THE PREFERRED EMBODIMENT

Figure 5:
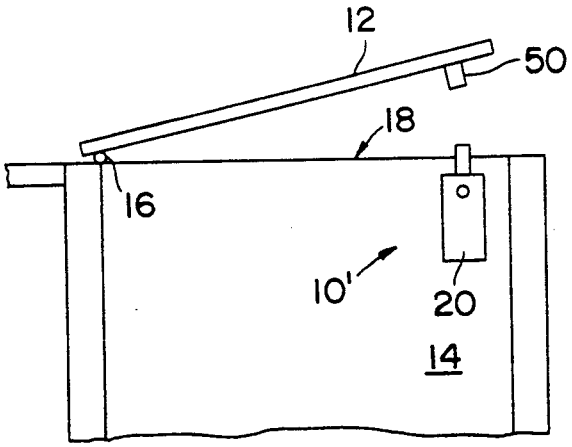
FIG. 5 is a view, also with parts in section, taken from the top of FIG. 1 with the latch assembly being released or unlocked and the door being in an open position.

Referring now to the drawings, a latch assembly is illustrated in accordance with the present invention which is of simple but reliable construction which is capable of positively locking a door in a closed position and also exerting a force for positively opening the door when the latch assembly is released or unlocked. The latch assembly is indicated generally at 10 in its closed condition in FIGS. 1–4 while being indicated generally at 10' in its released or unlocked condition in FIGS. 5–8.

The latch assembly of the present invention is further described below for use with a door 12 movably mounted on a frame 14. The door and frame are preferably of a type employed in cabinets and the like (not otherwise shown) with the door 12 being hinged along one side at 16 to the frame 14 adjacent an opening 18 for receiving the door. However, as noted above, it is to be understood that the latch assembly of the present invention may also be used together with a wide variety of doors. For example, the latch assembly may be used for hinged doors in applications other than cabinetry. At the same time, the latch assembly may also be employed with doors which are movable between open and closed positions relative to a frame, regardless of the manner in which the door is mounted relative to the frame.

As was also noted above, the latch assembly may be mounted either upon the door or the frame and in a variety of orientations while still accomplishing its basic functions of positively locking the door in a closed position and positively opening the door when the latch assembly is released or unlocked.

These basic functions are of course important in a variety of applications which are believed obvious. Particularly where the latch assembly is employed for cabinets, it is important to assure that the cabinet door remain closed and locked under all conditions including during earthquakes, for example. At the same time, it is of course important to provide a simple and effective manner for opening the door when the latch assembly is released or unlocked. As noted above, the latch assembly of the present invention is particularly effective in this regard since it exerts a positive force for opening the door upon release. This function is particularly useful in cabinets and the like where it may otherwise be difficult to grasp and open the door even after it is unlocked.

Referring primarily to FIGS. 1 and 5, the latch assembly 10 (or 10') includes a housing 20 which is adapted for attachment to the frame 14, for example, by means of screws (not shown).

The housing 20 is formed with first and second passageways 22 and 24 which are arranged in generally perpendicular and intersection relation, as may be best seen in FIGS. 2–4 and 6–8. The first passageway 22 is vertically arranged in the housing 20 as illustrated in FIGS. 1 and 5 while being opening at its upper end 26. The second passageway 24 is also open at one end 28 in facing relation with the door 12.

A first elongated pin 30 is positioned in the first passageway while a second elongated pin 32 is positioned in the second passageway.

Coil springs 34 and 36 respectively surround the first and second pins 30 and 32 and are respectively arranged in annular recesses 38 and 40 adjacent the first and second passageways. The recesses are illustrated as slots opening on opposite sides of the housing but could be otherwise formed if desired. A spring retainer 42 is transversely arranged in each of the pins 30 and 32 so that the respective spring acts in compression between the retainer 42 and one end of its annular recess for urging the respective pin toward the open end of its passageway.

The first passageway 22 is also open at its lower end 44 and is aligned with an opening 46 in the frame. The first elongated pin 30 extends through the opening 46 in the frame for engagement with an actuating means 48. The actuating means 48, preferably a lever coupled to the first pin 30, is thus manually operable for retracting the first pin in order to release or unlock the latch assembly as described in greater detail below.

As illustrated in the latch assembly 10 of FIG. 1, the first elongated pin 30 is illustrated in an extended condition so that it projects upwardly through the open end 26 of the housing. A bracket 50 is attached to the door, for example by screws, and has an inwardly projecting arm 52 forming an opening 54 for receiving and engaging the first pin 30 in its extended condition. A base portion 56 of the bracket preferably serves as a strike plate for the second pin as described in greater detail immediately below.

As also illustrated in FIG. 1, the second pin 32 is substantially fully retracted in its passageway when the door 12 is closed and the latch assembly is locked. In that condition, the second pin extends only slightly from the open end 28 of the housing so that the second pin is closely adjacent the base portion or strike plate 56 of the bracket 50. With the latch assembly 10 in the position described above and illustrated in FIGS. 1–4, the door 12 is thus positively locked in closed relation to the frame 14. However, the latch assembly readily permits the door to be opened in a particularly simple and effective manner as described below.

Referring now to FIGS. 5–8, the latch assembly is operated into a released or unlocked condition as illustrated at 10' simply by operation of the actuating lever 48 to retract the first pin 30. When the first pin 30 is retracted to the position illustrated in FIG. 6, it is disengaged from the bracket 50 and, at the same time, allows the second pin 32 to be extended by its spring 36 into engagement with the strike plate 56 for exerting a force to positively open the door 12 from the frame 14.

Figure 7:
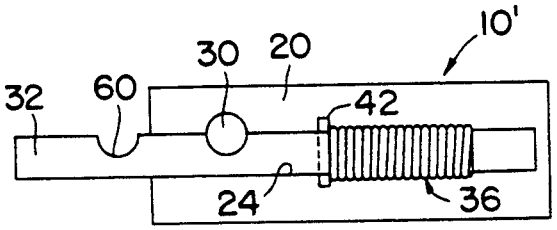
FIG. 7 is a view taken from the top of FIG. 6.
Figure 6:
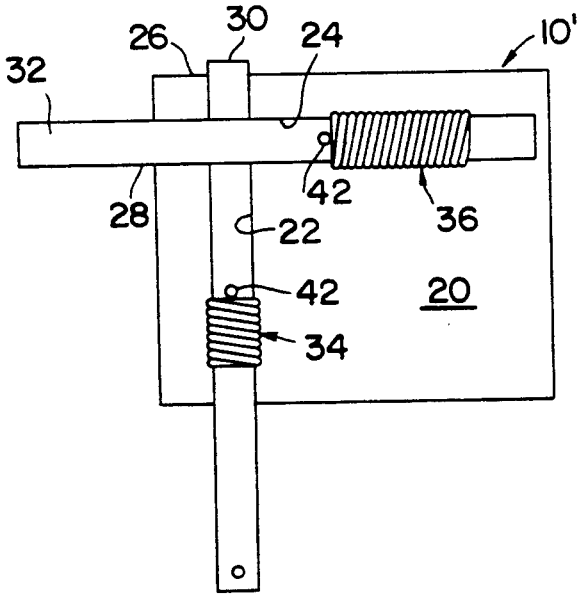
FIG. 6 is a similar view or representation as FIG. 2 of the latch assembly in a released or unlocked condition as is also illustrated in FIG. 5.
Figure 8:
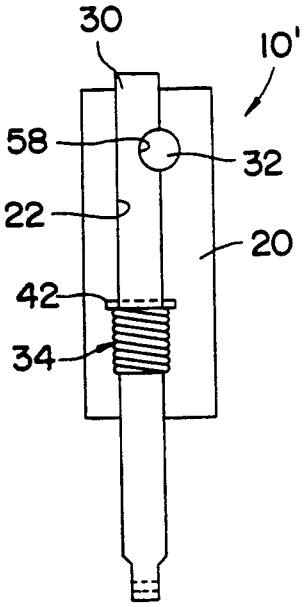
FIG. 8 is a view taken from the right side of FIG. 6.

The interaction of the first and second pins 30 and 32 is particularly facilitated because of the perpendicular and intersecting relation of the first and second passageways 22 and 24. Referring particularly to FIGS. 4 and 8, the first elongated pin 30 is formed with a recess 58. The recess 58 is formed along the length of the first pin 30 so that the recess is aligned with and completes the second passageway for the second pin when the first pin is substantially fully retracted in the position illustrated in FIGS. 5–8.

Similarly, the second elongated pin 32 is formed with a recess 60 also formed along its length so that the recess 60 is aligned with and completes the first passageway 22 when the second pin is substantially fully retracted as illustrated in FIGS. 1–4. The recess 60 formed in the second pin 32 is best illustrated in FIGS. 3 and 7.

In any event, the intersecting arrangement of the passageways and the formation of the recesses on the pins permits each of the pins to act as a retainer for the other pin until it is retracted so that its recess is aligned with the other pin. At that instant, the other pin is allowed to extend under the influence of its biasing spring and it thereafter acts as a retainer for the one pin until the other pin is again fully retracted.

The method of operation contemplated for the latch assembly is believed to be fully set forth above. However, in brief summary, with the latch assembly housing positioned on the frame as illustrated in the FIGURES and a bracket mounted upon the door, the door may be closed into the position illustrated in FIG. 1 so that the latch assembly is automatically shifted to its closed or locked condition. The door thus remains positively secured in relation with the frame until the actuating lever 48 is operated to retract the first spring as described above. At that time, the first pin is disengaged from the bracket and almost simultaneously, the second pin is allowed to be extended by its biasing spring so that it extends against the strike plate 56 to positively open the door.

Thereafter, when the door is again closed, the above sequence is repeated with the latch assembly being returned to its closed condition.

There has accordingly been described a particularly simple and effective latch assembly which is effective for positively locking a door in a closed position and positively opening the door when the latch assembly is released or unlocked. Numerous variations are believed possible in addition to the specific variations noted above for the embodiment described in FIGS. 1–8. In particular, as noted above, it is believed clearly apparent that the housing 20 could be mounted on the door as well as the frame. By suitable arrangement of components, the latch assembly would then operate in substantially the same manner for either positively locking the door in a closed position or positively opening the door when the latch assembly is released or unlocked. It is also possible to change the orientation of the latch assembly when it is mounted upon either the frame or door. For example, the housing 20 is illustrated in the figures with one end forming the opening 28 facing the door 12. The housing 20 could also be arranged with the second passageway 24 generally parallel to the door so that the second pin 32 would extend from the open end 28 of the passageway parallel with the door. Even in this arrangement, positive opening of the door could be accomplished by mounting a beveled bracket (not shown) on the door for engagement with the second pin. In that manner, extension of the second pin parallel to the door would similar serve to exert a positive force for opening the door. At the same time, when the door was again closed, the beveled bracket could cause the second pin to be retracted into the same position as generally indicated in FIGS. 1–4.

Accordingly, the scope of the present invention is defined only by the following appended claims which are further exemplary of the invention.

What is claimed is:

1. A latch assembly for a door movably mounted on a frame, the latch assembly being adapted for mounting on either the door or frame, comprising a latch assembly housing, a first pin movably mounted in a first passageway formed by the housing and open at one end, the first pin having spring means biasing it to extend outwardly from the open end of the first passageway, a second pin movably mounted in a second passageway formed by the housing and open at one end, the second pin having spring means biasing it to extend outwardly from the open end of the second passageway, the second passageway being perpendicular to and intersecting the first passageway, the first pin having a recess formed along its length so that, when the first pin is substantially retracted in the first passageway, its recess completes the second passageway for the second pin, the second pin having a recess formed along its length so that, when the second pin is substantially retracted in the second passageway, its recess completes the first passageway for the first pin, whereby each of the pins is urged into outward extension through the open end of its passageway when the other pin is in a substantially retracted position, the latch assembly thereby being adapted for positively locking the door in a closed position and positively opening the door when the latch assembly is unlocked.

2. The latch assembly of claim 1 wherein the latch assembly is mounted on one of the door and frame, an engagement means mounted on the other of the door and frame being a bracket with an arm extending toward the latch assembly and defining an opening for receiving the first pin.

3. The latch assembly of claim 2 wherein the first and second pins are elongated pins mounted for movement respectively in first and second elongated passageways formed by the housing, the latch assembly being mounted on one of the door and frame with an open end of the second passageway extending into facing relation with the other of the door and frame.

4. The latch assembly of claim 1 wherein the spring means for the first and second pins are arranged in the housing respectively adjacent the first and second passageways for interaction between the housing and the respective pins.

* * * * *